US005634831A

United States Patent [19]

Davies et al.

[11] Patent Number: 5,634,831

[45] Date of Patent: Jun. 3, 1997

[54] WATER JET PROPULSION UNIT FOR USE IN A JET BOAT

[76] Inventors: Richard G. Davies; Barry J. Davies, both of 15 Dundonald Street, Tainui, Dunedin, New Zealand

[21] Appl. No.: 416,758

[22] PCT Filed: Oct. 13, 1993

[86] PCT No.: PCT/NZ93/00095

§ 371 Date: Jun. 8, 1995

§ 102(e) Date: Jun. 8, 1995

[87] PCT Pub. No.: WO94/08845

PCT Pub. Date: Apr. 28, 1994

[30] Foreign Application Priority Data

| | | | |
|---|---|---|---|
| Oct. 13, 1992 | [NZ] | New Zealand | 244720 |
| Feb. 9, 1993 | [NZ] | New Zealand | 245870 |
| Jul. 2, 1993 | [NZ] | New Zealand | 248066 |

[51] Int. Cl.[6] ..... B63H 11/103

[52] U.S. Cl. ..... 440/47

[58] Field of Search ..... 440/38, 39, 40, 440/41, 42, 43, 47

[56] References Cited

U.S. PATENT DOCUMENTS

| | | | |
|---|---|---|---|
| 3,269,111 | 8/1966 | Brill . | |
| 3,561,392 | 2/1971 | Baez . | |
| 3,967,573 | 7/1976 | Charles et al. | 440/81 |
| 4,642,059 | 2/1987 | Noharah . | |
| 4,832,570 | 5/1989 | Solia . | |
| 5,030,149 | 7/1991 | Fujitat . | |
| 5,087,230 | 2/1992 | Yates et al. . | |

FOREIGN PATENT DOCUMENTS

| | | |
|---|---|---|
| 7-41570 | 8/1966 | Canada . |
| 1422618 | 1/1965 | France . |
| 1203635 | 10/1965 | Germany . |
| 394267A1 | 7/1991 | Germany . |
| 3-65491 | 3/1991 | Japan . |
| 123228 | 3/1959 | New Zealand . |
| 740606 | 11/1976 | U.S.S.R. . |
| WO93/01085 | 7/1991 | WIPO . |

OTHER PUBLICATIONS

"Ian Andrews Tests A Berkeley Jet Unit", Jet Boating, 1986, vol. 6, No. 8, pp. 45–47, at p. 46.

Mechanics of Fluids, Sec. Edition Si Units, by A.C. Walshaw and D.A. Jobson, Publishers Longman Group, London, pp. 156–158.

*Primary Examiner*—Stephen Avila

*Attorney, Agent, or Firm*—Jacobson, Price, Holman & Stern, PLLC

[57] ABSTRACT

A water jet propulsion unit intended for use in jet boats. The unit has an intake section, a pump section and a nozzle section. In the pump section there are two counter-rotating impellers on concentric counter-rotating shafts calibrated so that any radial flow created in the upstream impeller is converted into axial flow by the downstream impeller. In one embodiment the nozzle section has a throttled outlet to allow for a high mass/low pressure operation while maintaining pump priming. There are no support structures or stators downstream of the intake section in the preferred embodiment.

17 Claims, 5 Drawing Sheets

WATER JET PROPULSION UNIT FOR USE IN A JET BOAT

TECHNICAL FIELD

This invention relates to a water jet propulsion unit primarily for use in jet boats but able to be used in other water craft.

BACKGROUND ART

Water jet propulsion units are of two main kinds, a mixed flow and an axial flow configuration. A mixed flow unit is one in which the water enters the impeller parallel to the shaft and is directed radially from the shaft and leaves the impeller with radial and axial velocity. An axial flow unit is one where the water enters the impeller parallel to the shaft and also leaves the impeller parallel to the shaft. The differences are more fully explained in the publication "Jet Boating", November 1986, Volume 6, No. 8, page 46.

An example of an axial flow unit may be seen in New Zealand Patent Specification 123,228 where there is described a motor with two impellers, that is a two stage motor having a set of stators between the two impellers and another set of stators in the rear nozzle of the jet unit.

In DE 3942672 A1 there is described a mixed flow water jet propulsion unit. In the embodiments described there are two or three impellers in the pump section whose casing diverges from a narrower cross-sectional area at the inlet to a maximum cross-sectional area at the middle and converges to the minimum cross-sectional area at the outlet. The impellers are counter-rotating with respect to each other.

The provision of counter-rotating propellers mounted on concentric shafts is well known from the prior art, for example in U.S. Pat. Nos. 4,642,059; 4,832,570; 5,030,149; 5,087,230 and in WO 93/01085. It is desirable to use a concentric configuration in jet propulsion units so as to minimize obstructions causing turbulent flow within the pump casing and also to achieve maximum reliability under the extreme conditions encountered in a water jet propulsion unit.

It is an object of this invention to go some way towards achieving these desiderata or at least to offer the public a useful choice.

DISCLOSURE OF THE INVENTION

Accordingly the invention may be said broadly to consist in a water jet propulsion jet comprising:

an intake section;

a pump section; and a nozzle section;

the sections being in smooth communication with one another;

a single pair of counter-rotating impellers in said pump section, the downstream impeller being configured and calibrated to convert any radial flow created by the upstream impeller into axial flow, said counter-rotating impellers being each mounted on separate counter-rotating drive shafts, said drive shafts extending forwardly from said pump section through said intake section;

drive receiving means outside said intake portion on said drive shafts;

mounting means upstream of said counter-rotating impellers comprising one or more hydro-dynamic vanes, said counter-rotating shafts being bearingly mounted in said mounting means;

there being no support structures or stators downstream of said intake section; and said nozzle portion having an outlet of cross-sectional area from about 0.55 to less than the swept area of the forward of said impellers.

Preferably the outlet cross-sectional area of said nozzle can be adjusted.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

In each case the drawings have been simplified by omitting the deflector mechanisms associated with the nozzle outlet of the jet propulsion unit for providing reverse thrust and steerage. Such deflectors are well known in the art.

BEST MODE FOR CARRYING OUT THE INVENTION

Figure 1:
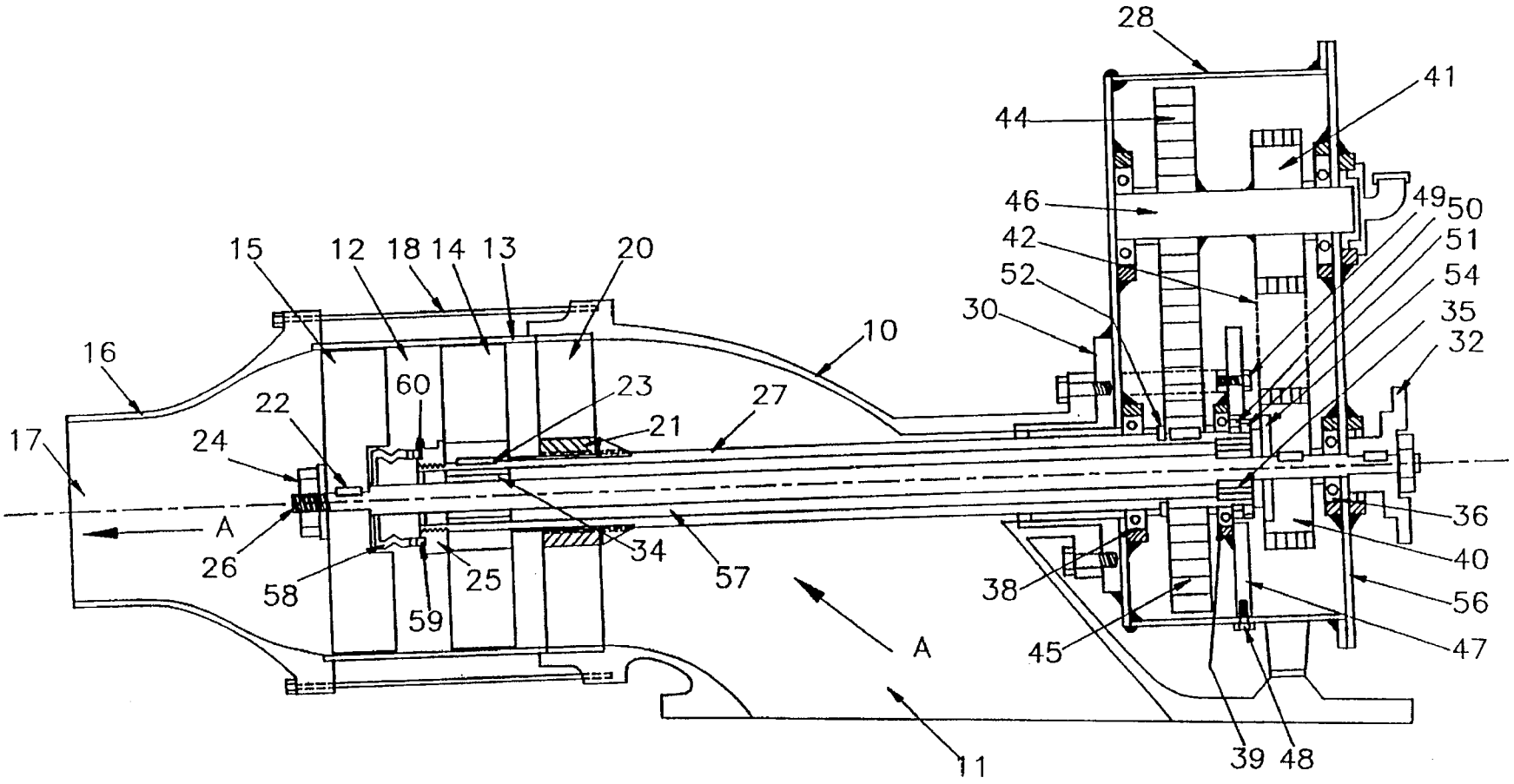
FIG. 1 is a side sectional elevation of a first embodiment of an axial flow pump to be driven by a motor mounted forward of the propulsion unit.

Construction and Operation of Embodiment of FIG. 1

The embodiment of FIG. 1 comprises an intake section 10 having an opening 11 flush with the bottom of the hull and covered by a screen (not shown). Immediately downstream of the intake section 10 is a two impeller axial flow pump section 12, which comprises a housing 13 and impellers 14 and 15. The nozzle section 16 is downstream of the pump section 12. Bolts 18 secure the nozzle section 16 and the pump section 12 to the intake section 10. The pump housing 13 in turn locates the three vane support 20 containing a water lubricated cutless bearing 21 inside the intake section 10. The nozzle section 16 has a frusto-conical shape having swept internal surfaces which curve into a straight tubular section at outlet 17.

The impellers 14 and 15 which may each have two or more blades are fixed into place by keys 23 and 22 and locking nuts 24 and 25 onto separate shafts 27 and 26 respectively. Each shaft is arranged to be driven in the opposite direction to the other. Each impeller 14 and 15 has its blades set in opposite orientation to those on the other so that the cancellation effect arising from the impellers 14 and 15 rotating in opposite direction to each other results in axial water flow through the nozzle section 16.

The two driving shafts 26 and 27 pass into a gearbox 28 which is bolted to a flange 30 on the intake section 10. The gearbox 28 is in turn driven by an engine (not shown) which attaches to the gearbox 28 via a drive flange 32 keyed to the inner driving shaft 26.

The inner shaft 26 is supported by bearings 34, 35 and 36, bearings 34 and 35 being set inside the outer driving shaft 27, which is in turn supported by the cutless bearing 21 in pump section 12, and two further bearings 38 and 39 in gearbox 28. Within the gearbox 28 are two sprockets 40 and 41 which are linked by a chain 42, shown by broken lines, and two gears 44 and 45. The first driving sprocket 40 is fixed to the inner driving shaft 26, with power being transmitted to the second driving sprocket 41 via the chain 42. The second driving sprocket 41 is fixed to a third transmission shaft 46 to which is also fixed one of the gears 44. This gear 44 meshes with the second gear 45 which is fixed to the outer driving shaft 27. Driving of the input flange 32 results in each of the shafts 26 and 27 turning in-opposite directions. Gear 44, 45 and sprocket 40, 41 ratios may be altered but where diesel engines are used to drive the impellers 14 and 15, relative driving ratios are set typically at 1:1 so that both driving shafts 26 and 27 turn at the same rate as that of the engine.

Reaction thrust resulting from the impellers 14 and 15 is accepted by the angular contact bearings 36 and 39. A bearing thrust/support plate 47 is fixed inside the gearbox 28 by means of bolts or screws 48 and 49 and serves as a means of containment for the rear angular contact bearing 39 supporting the outer driving shaft 27. The outer driving shaft 27 is fixed into position by two lock-nuts 50 and 51 which lock the inner bearing hub of the rear angular contact bearing 39 and the gear 45 against a circlip 52.

An additional axial needle roller 54 set inside the inner shaft sprocket 40 provides a load bearing surface between the end of the outer shaft 27 and the inner shaft sprocket 40, so that the angular contact bearing 36 can be pre-loaded when the gearbox lid 56 is screwed or bolted into place. An idler sprocket (not shown) serves to take up back-lash in the chain when under driving load.

In order to prevent water entering the space 57 between the two shafts 26 and 27 from inside the pump-housing 13, a mechanical seal 58 is set inside the hub of the rear impeller 15. A stainless steel seat 59 for the mechanical seal 58 is fixed into a groove 60, machined into the back of the retaining nut 25 which locks the upstream impeller 14 into place.

The needle-roller bearing 34 is lubricated by oil which passes through the needle-roller bearing 35 from the gearbox 28 into the space 57 between the two shafts 26 and 27.

In operation when drive from an engine is engaged with flange 32 it rotates inner shaft 26. This in turn rotates sprocket 40 whose drive is transmitted by chain 42 to sprocket 41 to drive shaft 46. Gear 44 on shaft 46 is rotated and meshes with gear 45 on outer shaft 27 to rotate shaft 27. Thus upstream impeller 14 is rotated on shaft 27 and downstream impeller is rotated on shaft 26. Water flows through the unit in the direction of arrows A.

Figures 2, 2A:
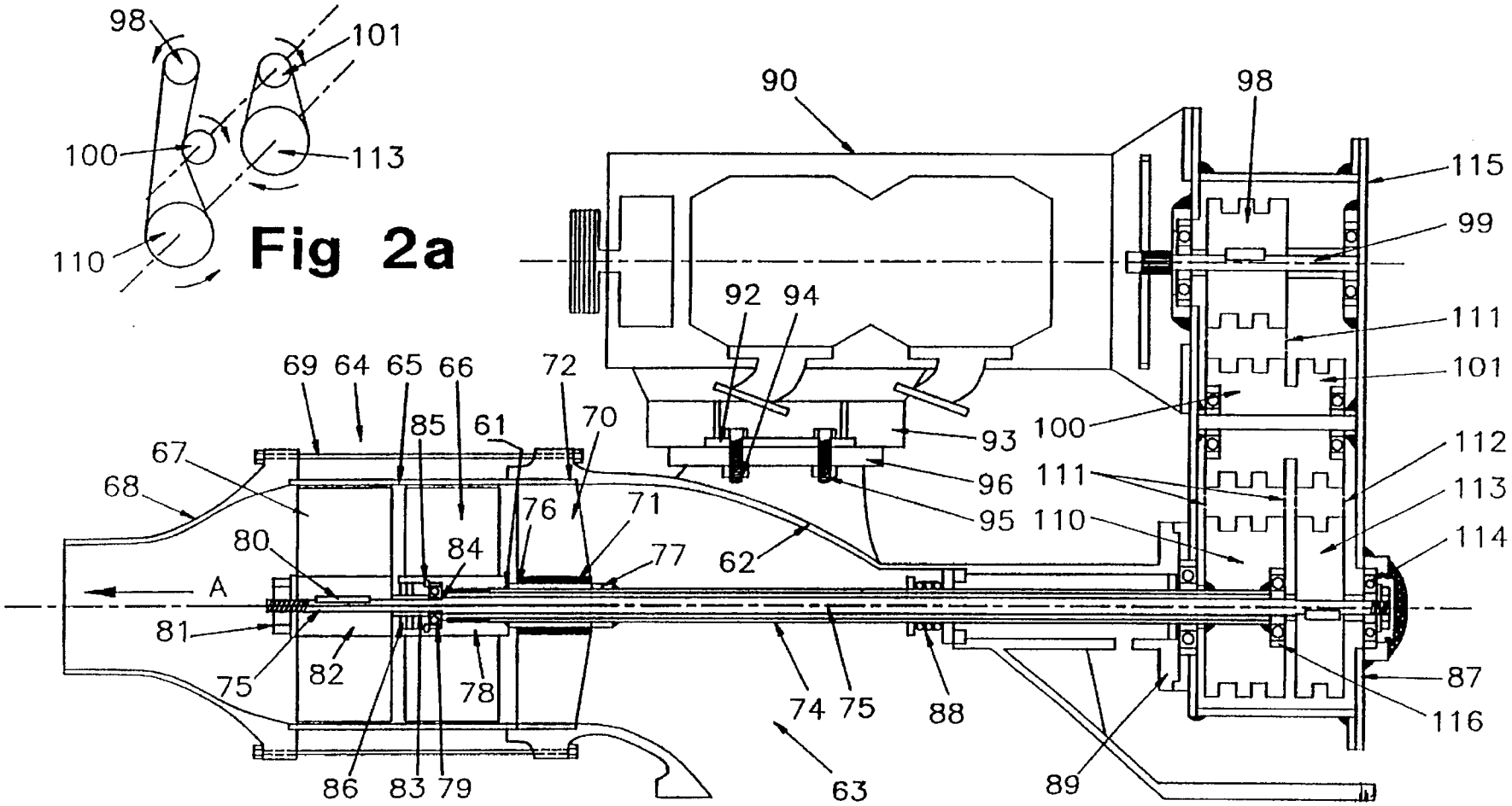
FIG. 2 is a side sectional elevation of a second embodiment axial flow pump to be driven by a motor which is mounted on the outside of the housing of the intake section of a propulsion unit.

Construction and Operation of Embodiment of FIG. 2

The embodiment described with reference to FIG. 2 is an axial flow pump which can be calibrated to operate either as a low pressure/high mass pump (operating at up to about 40 psi) or a high pressure/low mass pump (operating at up to about 100 psi). The pump comprises an intake section 62 having an opening 63 flush with the bottom of the hull of the boat in which it is installed and covered by a screen (not shown). A two impeller axial flow pump section 64 comprises a pump-housing 65, which is a parallel walled tube and impellers 66 and 67. Downstream again is a nozzle section 68. Bolts 69 secure the nozzle 68 and pump housing 65 to the intake section 62. A three vane support 70, containing a water lubricated cutless bearing 71, is sandwiched between the pump-housing 65 and intake housing 62, the support 70 being located centrally in a recess 72 in the intake housing 62.

The upstream intake impeller 66 screws or threads onto the outer driving shaft 74, seating against a replaceable wear sleeve 76 which in turn locates against a fixed locating ring 77. A rubber "o" ring 61 sandwiched between the impeller hub 78 and the wear sleeve 76 prevents water or contaminants entering the bearing 79 and the space between the two shafts 75 and 74. The impeller 66 is of an "axial flow" configuration permitting the incoming water to accelerate along the driving blades. The accelerated water moves along the inner wall of the pump housing 65 to impinge on the second or downstream impeller 67, also of axial flow configuration, which rotates in the opposite direction to the upstream impeller 66. The effect of this is to straighten the water as it leaves the downstream impeller blades. The impeller 67 is fixed to the inner driving shaft 75 by means of a key 80 and a locking nut 81. The downstream impeller hub 82 locates against a wear sleeve 83 and the bearing 79, which in turn bears on a shoulder 84 on the inner shaft 75. The inner shaft 75 is supported/located within the pump-housing 65, by the bearing 79 located within the hub 78 of the upstream impeller 66 by a snap-ring 85. Both of the driving shafts 74 and 75 are in turn supported by a cutless bearing 71 inside the three vane support 70. Lip seals 86 pressed into the rear of the upstream impeller hub 78 serve to also exclude water from the bearing 79.

The two driving shafts 74 and 75 pass into a sprocket/chain transmission housing 87 through a mechanical seal 88. The housing 87 is bolted (bolts not shown) to a flange 89 on the intake section 62 and is further attached to a petrol engine 90 which is in turn fixed directly to the intake section 62. In this case a flange 92 fixed to the engine sump 93 allows the engine to be bolted with bolts 94 and 95 directly to a flange 96 formed as part of the intake section 62. The configuration thus shown in FIG. 2 enables the saving of useful space within small to medium sized pleasure boats.

A primary drive sprocket 98, fixed to the engine input shaft 99, drives the two coupled sprockets 100 and 101 and the drive sprocket 110, fixed to the external drive-shaft 74 via a chain 111 (indicated by a dotted line). Reference should be made to FIG. 2A which describes the means of providing counter-rotation of the driving shafts 74 and 75. The sprockets 100 and 101 are fixed to the same shaft or hub to transmit power between the chain 111 and the chain 112. The coupled sprocket 101 in turn drives the sprocket 113 via the chain 112, the sprocket 113 being fixed to the inner drive-shaft 75. Reaction thrust resulting from the impellers 66 and 67 is accepted by the angular contact bearing 114, mounted inside the transmission-housing lid 115, with thrust from the outer shaft 74 being transmitted to the bearing 114 via the angular contact bearing 116, located inside the hub of the sprocket 110.

A mechanical advantage can be provided to the engine by altering the drive ratio between the primary drive sprocket 98 and the remaining sprockets 100, 101, 110 and 113. It is not intended that the means of power transmission previously described should limit the means by which impeller rotation can be achieved in that other means are possible which could include, for example, the use of gears, belts, chains and/or a combination thereof.

The operation of the embodiment of FIG. 2 within the propulsion unit is identical to that in FIG. 1. Drive from engine 90 is transmitted through the transmission in the manner described in relation to FIG. 2A to counter-rotate shafts 74 and 75 and their respective impellers 67 and 66. Water is propelled through the unit in the direction of arrow A, any radial flow imparted by impeller 66 being reconverted to axial flow by impeller 67.

Figures 3, 3A:
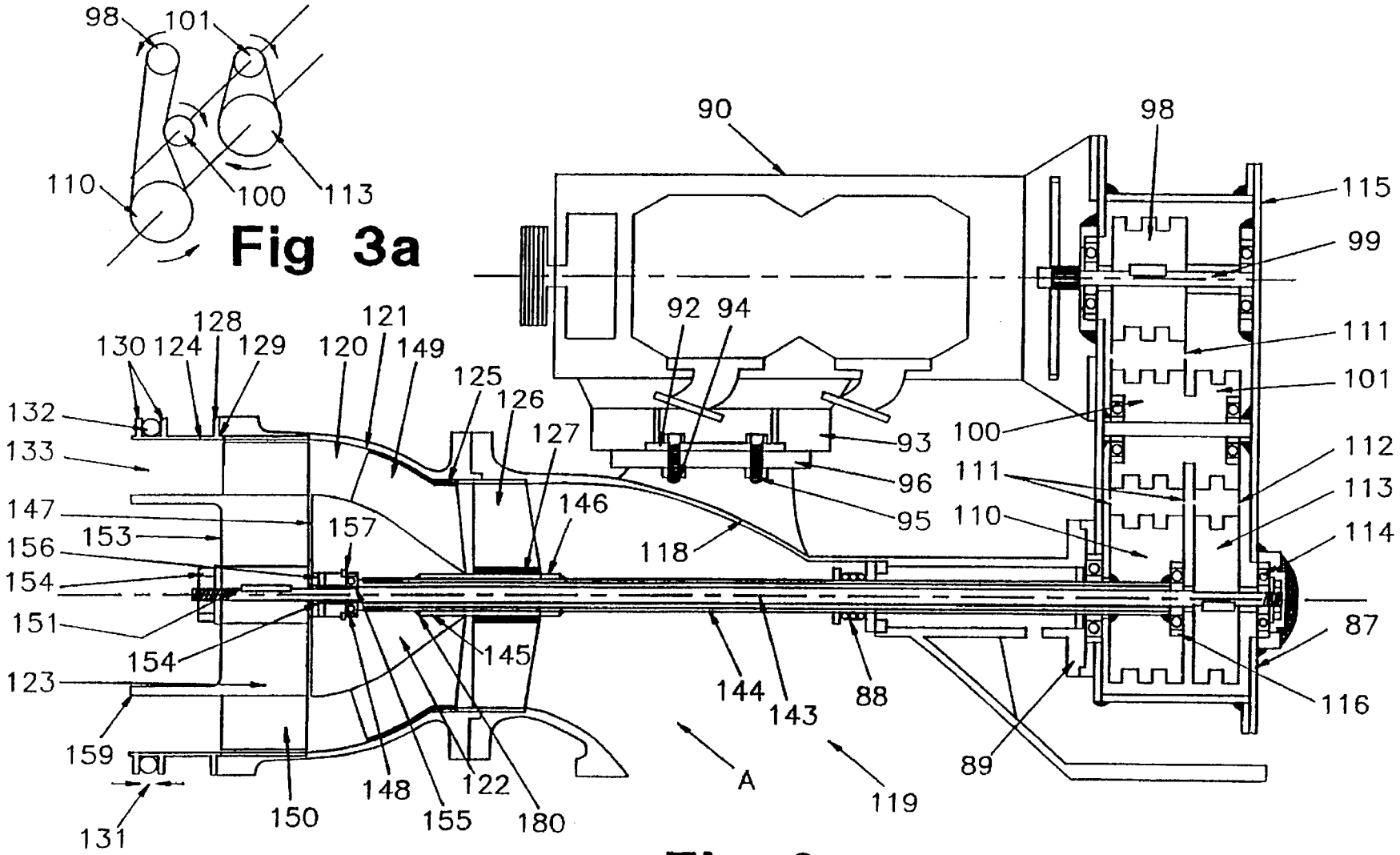
FIG. 3 is a side sectional elevation of a first embodiment of a mixed flow pump in which the motor is also mounted on the housing of the intake seciton of the jet propulsion unit.

Construction and Operation of Embodiment of FIG. 3

The embodiment described with reference to FIG. 3 can be calibrated to operate either as a low pressure/high mass pump (operating at the lowest possible pressure to maintain the intake section 118 and the pump section 120 priming at all rotational speeds of the pump to maximize mass flow) or a high pressure/low mass pump (operating at up to about 100 psi) comprising an intake section 118 having an opening 119 flush with the bottom of the hull to the boat in which it is installed and covered by a screen (not shown). Downstream from the intake section is a two impeller mixed-flow pump section 120 which comprises a pump-housing 121 and impellers 122 and 123. Further downstream is the nozzle section comprising throttling device 124. Bolts (not shown) secure the pump housing 121 to the intake section 118. A wear ring 125 is fixed to the pump housing 121, locating the three vane support 126 containing a water lubricated cutless bearing 127 in the intake section 118.

In one embodiment the nozzle throttling device 124 comprises a series of thin flexible strips 134 (seen best in FIGS. 6 and 7) fixed to a circular rim 128, preferably constructed of stainless steel or other appropriate material, which fits into a recess 129 in the pump housing 121. Fixing screws or bolts (not shown) through flange 135 retain the nozzle section 124 in place to prevent dislodgement by the jet stream. At the end of each strip is a fixed pair of retainers 130 which allows for a more or less continuous groove 131 around the end of the nozzle throttling device 124. The location of the groove 131 is also indicated by the dotted line in FIG. 7. This groove 131 provides containment for a flexible rubber ring or, alternatively, a coil-spring 132, which when tensioned causes the nozzle opening 133 to contract. Calibration of the tension in the rubber ring or spring 132 is thus a means of providing back-pressure inside the pump housing 121, sufficient to prime the pump. As the pump pressure increases, with increasing flow, the nozzle throttling device 124 opens and priming is maintained at the lowest possible pressure throughout the operating range of the pump. Not shown in the drawings is a thin rubber sleeve fitted over the strips 134 (FIG. 7) to prevent water loss.

Figure 4:
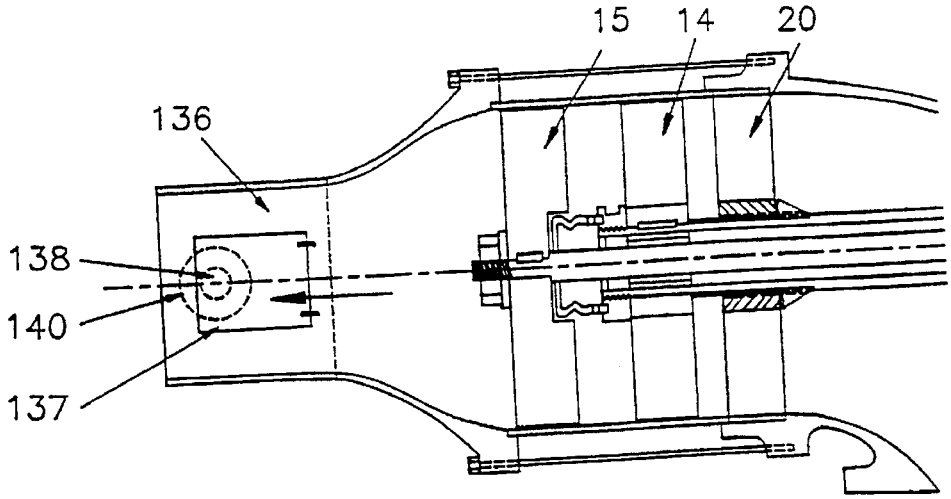
FIG. 4 is a side sectional elevation of the rear portion of the intake section, the pump section and the nozzle section of the embodiment of FIG. 1 showing a first embodiment of a nozzle throttle.
Figure 5:
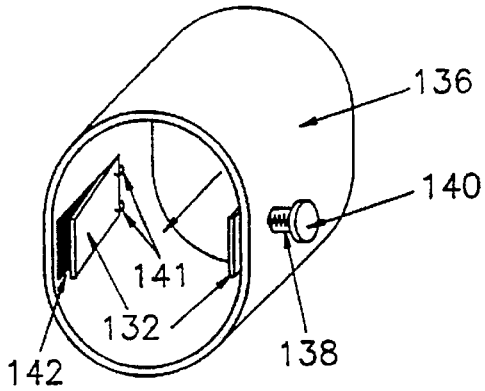
FIG. 5 is a rear perspective view of the nozzle throttle of FIG. 4.

Alternative means of throttling the pump are illustrated in FIGS. 4 and 5. FIG. 5 is a perspective view of a nozzle throttling device 136, utilising spring-loaded flaps 137 which can be calibrated to achieve the required back pressure by altering the tension on each spring 138 by the use of an externally adjustable screw 140. The flaps 137 are hinged on hinges 141 and are able to move back into a recess 142 in the wall of the nozzle throttling device 136 as the flow rate increases. The nozzle throttling device 136, in this case, can be attached (means of attachment not shown) downstream of the stern impeller 15 (as seen in FIG. 4) or form part of the nozzle casting or structure.

The present invention is not limited to the means of controlling pump pressure previously described. These means are merely to indicate how throttling of the pump can be achieved.

The upstream intake impeller 122 screws or threads onto the outer driving shaft 144, seating against a replaceable wear sleeve 145 which in turn locates against a fixed locating ring 146. A rubber "o" ring 180 sandwiched between the impeller hub 147 and the wear sleeve 145 prevents water or contaminants entering the bearing 148 and the space between the two shafts 143 and 144. The impeller 122 is of a "mixed flow" configuration permitting the incoming water to accelerate radially and axially along the driving blades 149. The accelerated water moves along the inner wall of the pump housing 121 to impinge on the downstream impeller 123, which rotates in the opposite direction to the upstream impeller 122. The effect of this is to straighten the water as it leaves the downstream impeller blades 150, thereby maximizing reaction thrust. The impeller 123 is fixed to the inner driving shaft 143 by means of a key 151 and a locking nut 152. The impeller hub 153 locates against a wear sleeve 154 and the bearing 148, which in turn bears on a shoulder 155 on the inner shaft 143. The inner shaft 143 is supported/located within the pump-housing 121 by the bearing 148 located within the hub 147 of the upstream impeller 122 by a snap-ring 157. Both of the driving shafts 143 and 144 are in turn supported by the cutless bearing 127 which is inserted inside the three vane support 126. Lip seals 156 pressed into the rear of the upstream impeller hub 147 serve to also exclude water from the bearing 148.

The transmission and engine for this embodiment are the same as for the embodiment of FIG. 2.

The two driving shafts 143 and 144 pass into a sprocket/chain transmission housing 115 through a mechanical seal 88. The housing 115 is bolted to a flange 89 on the intake section 118 and is further attached to a petrol engine 90, which is in turn fixed directly to the intake section 118. In this case a flange 92 fixed to the engine sump 93 allows the engine to be bolted by bolts 94 and 95 directly to a flange 96 formed as part of the intake section 118. The configuration thus shown in FIG. 3 enables the saving of useful space within small to medium sized pleasure boats. A primary drive sprocket 98 fixed to the engine input shaft 99, drives the two coupled sprockets 100 and 101 and the drive sprocket 110, fixed to the external drive-shaft 144 via a chain 111 indicated by a dotted line. Reference should be made to FIG. 3A which illustrates the means of providing counter-rotation of the driving shafts 143 and 144. The sprockets 100 and 101 are fixed to the same shaft or hub, their purpose being to transmit power between the chain 111 and the chain 112. The coupled sprocket 101 in turn drives the sprocket 113 via the chain 112, the sprocket 113 being fixed to the inner drive-shaft 143. Reaction thrust resulting from the impellers 122 and 123 is accepted by the angular contact bearing 114, mounted inside the transmission-housing lid 87, with thrust from the outer shaft 144 being transmitted to the bearing 114 via the angular contact bearing 116 located inside the hub of the sprocket 110.

A mechanical advantage can be provided to the engine by altering the drive ratio between the primary drive sprocket 98 and the remaining sprockets 100, 101, 110 and 113. It is not intended that the means of power transmission previously described should limit the means by which impeller rotation can be achieved in that other means are possible which could include, for example, the use of gears, belts, chains and/or a combination thereof.

Figure 6:
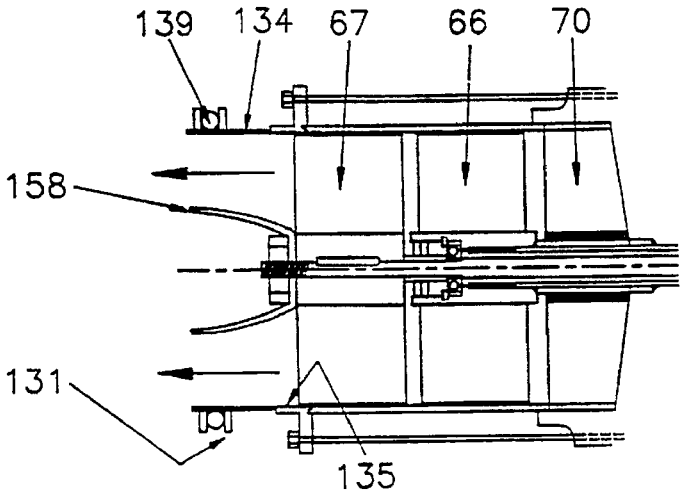
FIG. 6 is a side sectional elevation of a pump section of the embodiment of FIG. 2 to which a nozzle incorporating an alternative throttling device has been attached.

FIG. 6 describes a further nozzle throttling device which is substantially the same as that described in the embodiment of FIG. 3, but which is suitable for an axial flow pump such as that described in relation to FIG. 2. The outer part (shown in FIG. 7) comprises the flexible strips 134 and attaching ring 135, with the groove 131 and rubber band or spring 139 at the outlet end of the assembly providing a means of controlling the nozzle outlet area (represented by a dotted line in FIG. 7). The downstream impeller 67 has a cup shaped extension 158 attached to its stern end, as a separate fixture, or formed as part of the impeller 67 itself. This extension 158 has its diameter calibrated to the flow rate of the jet emerging from the pump, and also acts to prevent air entering the pump in a reverse direction up the centre of the jet plume, as it emerges from the nozzle throttling device. The impeller extension 158 is thus a functional part of the nozzle throttling device itself.

The extension 159 shown on the end of the impeller hub 153 in FIG. 3 also serves the same purpose as that of extension 158 described above.

Operation of Throttling Device

The operation of the propulsion unit in FIG. 1 in conjunction with the alternative nozzle throttling devices in FIGS. 4 and 5 and in FIGS. 6 and 7 will now be described. The engine and transmission operation are the same as described above in relation to FIG. 1. Upstream impeller 14 creates a substantially axial flow of water as it passes through the unit in the direction of arrow A. Downstream impeller 15 rotating in the opposite direction reconverts any non-axial flow to an axial flow. When the impellers 14 and 15 are rotating at a low rotational speed, springs 138 in the throttle device 136 (FIGS. 4 and 5) urge flaps 137 inwardly to the limit of their travel. This allows for the build up of sufficient back pressure to prime the propulsion unit at the lowest possible flow through pressure. As the rotational speed of the impellers increases, the increasing flow through pressure of water pushes flaps 137 entirely into their recesses 142. Thus the water pressure flowing through is able to be maintained at a substantially constant reduced pressure determined by the ratings of springs 138 and the ratio of the cross-sectional area of the outlet of the nozzle device and the swept area of impeller 16.

Figure 7:
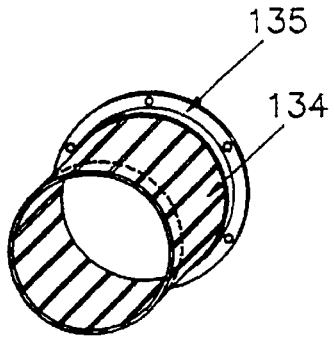
FIG. 7 is a rear perspective view of the throttling device of the nozzle illustrated in FIG. 6.

The throttle unit shown in FIGS. 6 and 7 operates in a similar fashion. Drive is transmitted to impellers 66 an 67 as described in relation to FIG. 2. At lowest rotational speeds and lowest water pressure, rubber band or spring 139 compresses flexible strips 134 together to the maximum extent needed to create the maximum back pressure by minimizing the nozzle opening area. As the impellers increase their speed, the increasing flow pressure pushes strips 134 outwardly against the band of spring 139, maintaining the same sort of equilibrium. In another embodiment the spring 139 is tightened mechanically by remote means such as a bowden cable to enhance priming.

Figure 8:
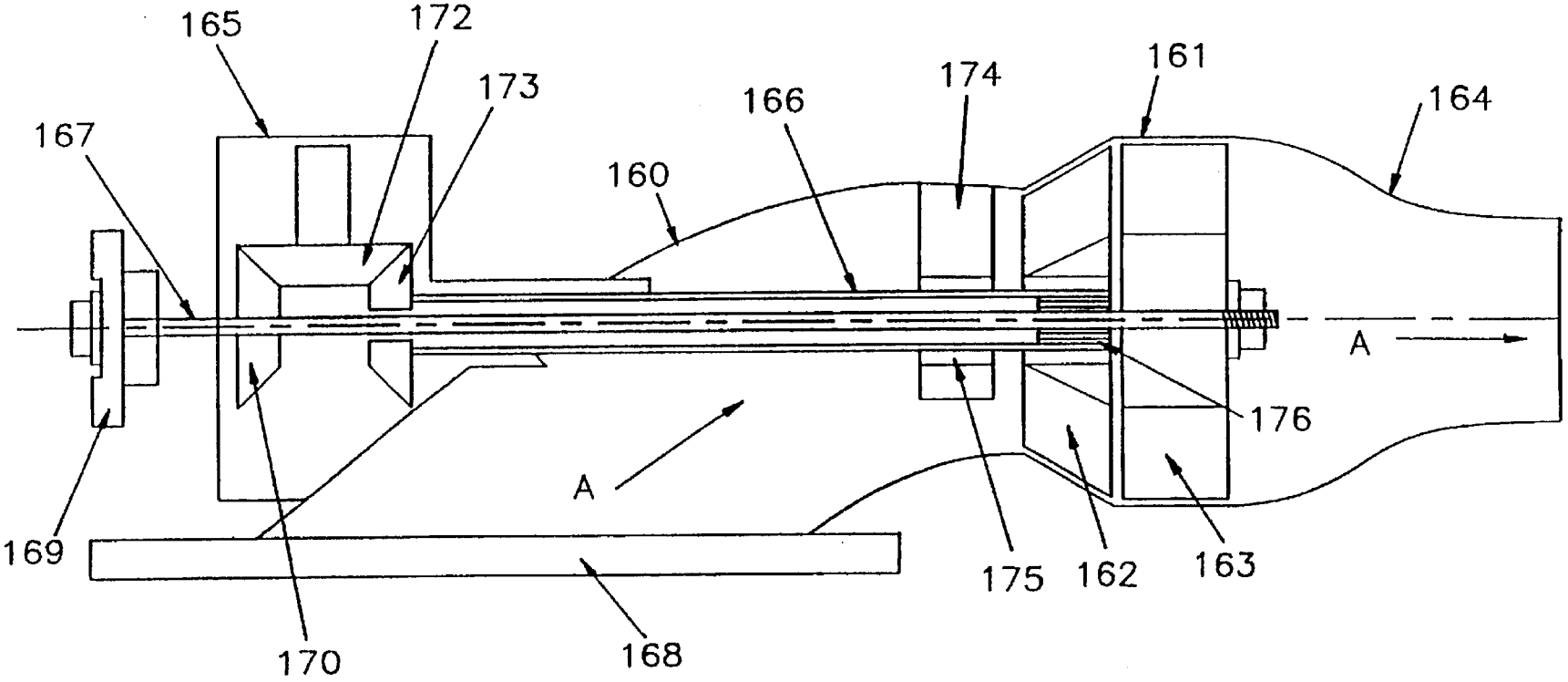
FIG. 8 is a side elevational view of a second embodiment of a mixed flow pump having an alternative driving gear.

Construction and Operation of Embodiment of FIG. 8

The embodiment illustrated by FIG. 8 generally comprises an intake section 160, pump-housing section 161 containing impellers 162 and 163, nozzle section 164 and a gearbox 165. Shafts 166 and 167 provide counter-rotation of the impellers 162 and 163. Water from the intake 168 is drawn via the intake-housing 160 into the upstream impeller 162 and accelerated radially and axially around the inner wall of the pump-housing section 161. The accelerated water then impinges on the downstream impeller 163 which rotates in the opposite direction to the upstream impeller 162. The effect of this is to straighten the water as it enters the pressurized nozzle section 164, thus ensuring that the reaction force or thrust is maximized as the water is ejected from the nozzle section 164. The bowl-shaped pump-housing section 161 is shaped thus so that maximum acceleration of the incoming water from the intake-housing 160 is achieved before it impinges on the second impeller 163. The departure from conventional mixed flow pumps, having both radial and axial flow in the pump-housing section 161, is that a parallel walled section, containing a counter-rotating impeller 163, is fitted downstream of the mixed flow impeller 162. The radial component of the mixed flow is thereby cancelled before the resulting axial flow enters the nozzle section 164.

A drive flange 169 driven by an engine (not shown) is connected to the input or impeller driving shaft 167 to which is further attached a bevel gear 170. This bevel gear 170 meshes with a second transmission bevel gear 172 which drives a third bevel gear 173 fixed to the outer impeller driving shaft 166. To this impeller driving shaft 166 is fixed the upstream impeller 162. The inner impeller driving shaft 167 has the downstream impeller 163 attached at its nozzle section end 164.

In an alternative embodiment allowing more precise control of gear drive ratios and permitting a top mounted engine configuration the engine input drive may be connected to the vertical shaft of the bevel gear 172.

A support 174 attached to the inner wall of the intake-housing 160 contains a cutless bearing 175 which supports the outer impeller driving shaft 166. The outer impeller driving shaft 166 contains a further bearing 176 which supports the inner impeller driving shaft 167. Containment bearings for the gears 170, 172 and 173 are not shown.

The operation of the embodiment of FIG. 8 is substantially the same as that of the embodiment of FIG. 3. The radial component of water created by impeller 162 is converted to axial thrust by impellers 163.

Calibration of Components

This description broadly outlines a device which maximizes reaction force by the use of a pair of counter-rotating impellers which in turn drive a pressurized nozzle section.

Further, it is not intended that the scope of the invention be limited by the means by which the counter-rotation of the impellers is achieved. The driving shafts for the impellers could be driven by a variety of means which could include, for example, the use of chains, sprockets, belts or combinations thereof.

The jet propulsion units herein illustrated can be configured and calibrated to act either as a high pressure pump able to operate at pressures of up to about 100 psi or a low pressure pump operating at pressures of up to about 40 psi. This section configuration is the more efficient.

The provision of a throttling device on the nozzle, however, allows variation of the cross-sectional area of the nozzle outlet, permitting the internal pressure of the pump to be minimised still further by allowing the nozzle to open as the impeller speed increases. This means that the increasing mass transfer through the pump occurs at the lowest possible internal pump pressure throughout the operating range of the pump, thus improving the efficiency of the pump.

The operating pressure is controlled by varying the nozzle cross-sectional area, the impeller blade angle or pitch and the impeller speed. The mode of operation can be determined by the ratio between the nozzle outlet area and the swept area of the upstream impeller:

1. A low pressure fixed nozzle configuration has a 2×30° blade angle impellers having an outside diameter of 190 mm, a hub diameter of 75 mm, and an axial configuration with a fixed nozzle. The ratio of nozzle outlet area to swept area of the upstream impeller is about 0.55. This ratio may be increased by using an adjustable nozzle.

2. A high pressure fixed nozzle configuration has 2×17° blade angle impellers having an outside diameter of 190 mm, a hub diameter of 75 mm and an axial configuration. The ratio of the nozzle outlet to swept area of the upstream impeller is around 0.3.

These parameters are not limitative of the invention but are illustrations of how the jet propulsion unit may be calibrated for low pressure or high pressure operation.

In a mixed flow propulsion unit as is illustrated in FIGS. 3 and 8, the larger diameter downstream axial flow impeller is calibrated by variation of the blade angle and peripheral velocity to remove the radial component imposed by the upstream mixed flow impeller.

For low pressure flow propulsion units with larger nozzle outlet areas, throttling is advantageous to ensure that the jet propulsion unit is primed adequately. As the impellers begin to turn they must supply a large charge volume of water immediately and some back pressure is required for priming.

We claim:

1. A water jet propulsion unit comprising:

an intake section;

a pump section; and a nozzle section;

the sections being in smooth communication with one another;

a single pair of counter-rotating impellers in said pump section, the downstream impeller being configured and calibrated to convert any radial flow created by the upstream impeller into axial flow, said counter-rotating impellers being each mounted on separate counter-rotating drive shafts, said drive shafts extending forwardly from said pump section through said intake section;

drive receiving means outside said intake portion on said drive shafts;

mounting means upstream of said counter-rotating impellers comprising one or more hydro-dynamic vanes, said counter-rotating shafts being bearingly mounted in said mounting means;

there being no stators downstream of said intake section; and said nozzle portion having an outlet of cross-sectional area from about 0.55 to less than the swept area of the forward of said impellers so that the unit is operated in a high mass/low pressure mode.

2. A water jet propulsion unit as claimed in claim 1 in which the outlet end of said intake section and said pump section are substantially cylindrical and of the same diameter.

3. A water jet propulsion unit as claimed in claim 1 wherein said impellers are axial flow impellers of substantially the same diameter.

4. The water jet propulsion unit as claimed in claim 1 in which the blades on said upstream impeller and said downstream impeller are approximately at the same pitch and the shafts on which they are mounted are calibrated to rotate at the same speed.

5. A water jet propulsion unit as claimed in claim 1 in which intake section and said pump section are substantially cylindrical, said pump section being of greater diameter than said intake section, the cross-sectional area of said intake section diverging smoothly to the cross-sectional area of said pump section.

6. A water jet propulsion unit as claimed in claim 5 wherein the upstream of said impellers is of a mixed flow design and the downstream of said impellers is of an axial flow design.

7. A water jet propulsion unit as claimed in claim 1 in which the nozzle outlet area is adjustable.

8. A water jet propulsion unit according to claim 7 in which said nozzle outlet area is adjustable by the pressure of water.

9. A water jet propulsion unit according to claim 7 wherein said nozzle outlet area is adjustable manually.

10. A water jet propulsion unit according to claim 1 in which the drive receiving means comprises sprockets.

11. A water jet propulsion unit according to claim 1 in combination with driving means and transmission means.

12. A water jet propulsion unit as claimed in claim 11 in which said transmission means comprises chains and sprockets between said driving means and said drive receiving means.

13. A water jet propulsion unit according to claim 11 in which said transmission means comprises bevel gears between said driving means and said drive receiving means.

14. A water jet propulsion unit according to claim 1 in which said driving means is an engine mounted on said jet propulsion unit.

15. A water jet propulsion unit as claimed in claim 11 in which said transmission means is calibrated to drive said impeller shafts at a speed less than the speed of said engine.

16. A water jet propulsion unit as claimed in claim 1 which said nozzle has a fixed outlet area and the ratio of the nozzle outlet cross-sectional area to the swept area of said upstream impeller is about 0.55.

17. A water jet propulsion unit as claimed in claim 11, wherein said transmission means includes a combination of gears, chains and sprockets.

* * * * *